US008839976B2

(12) United States Patent
Morris, Jr.

(10) Patent No.: US 8,839,976 B2
(45) **Date of Patent: *Sep. 23, 2014**

(54) LOCKING LID CONTAINER

(76) Inventor: Glenn H. Morris, Jr., Chattanooga, TN (US)

( * ) Notice: Subject to any disclaimer, the term of this patent is extended or adjusted under 35 U.S.C. 154(b) by 401 days.

This patent is subject to a terminal disclaimer.

(21) Appl. No.: 12/814,537

(22) Filed: Jun. 14, 2010

(65) Prior Publication Data

US 2013/0126530 A1 May 23, 2013

(51) Int. Cl.
*B65D 41/04* (2006.01)
*B65D 50/04* (2006.01)

(52) U.S. Cl.
CPC ..... *B65D 50/046* (2013.01)
USPC ..... 220/288

(58) Field of Classification Search
USPC ..... 220/326, 324, 323; 215/263, 330
See application file for complete search history.

(56) References Cited

U.S. PATENT DOCUMENTS

| | | | |
|---|---|---|---|
| 1,232,741 | A | 7/1917 | West |
| 1,498,416 | A | 6/1921 | Willett |
| 2,084,568 | A | 6/1935 | White |
| 2,459,668 | A | 5/1944 | Melichar |
| 2,445,802 | A | 1/1945 | Robinson |
| 2,906,429 | A | 7/1955 | Marchyn |
| 2,866,574 | A | 1/1957 | Roumeliotis |
| 2,893,590 | A | 7/1957 | Buckley |
| 2,907,492 | A | 2/1958 | Robertson |
| 3,058,527 | A | 10/1962 | Dennis et al. |
| 3,127,049 | A | 3/1964 | Welty et al. |
| 3,128,005 | A | 4/1964 | Sherlock |
| 3,181,718 | A | 5/1965 | Chancellor |
| 3,311,253 | A | 3/1967 | Pechacek |
| 3,376,992 | A | 4/1968 | Klapp, Sr. |
| 3,458,079 | A | 7/1969 | Gasbarra |
| 3,514,003 | A | 5/1970 | Fitzgerald |
| 3,612,323 | A | 10/1971 | Malick |
| 3,648,876 | A | 3/1972 | Berman |
| 3,744,655 | A | 7/1973 | Nixdorff, Jr. |
| 3,844,438 | A | 10/1974 | St. Pierre et al. |
| 3,902,620 | A | 9/1975 | McIntosh |
| 3,942,679 | A | 3/1976 | Starr |
| 3,977,563 | A | 8/1976 | Holt |
| 4,053,077 | A | 10/1977 | DeFelice |
| 4,063,639 | A | 12/1977 | Grant |
| 4,154,354 | A | 5/1979 | Ryder |
| 4,198,040 | A | 4/1980 | Colasent |
| 4,244,920 | A | 1/1981 | Manschot et al. |
| 4,245,753 | A | 1/1981 | Ellis |
| 4,288,000 | A | 9/1981 | Luker et al. |
| 4,293,080 | A | 10/1981 | Letica |
| 4,308,970 | A | 1/1982 | Von Holdt |
| 4,347,947 | A | 9/1982 | Hammes |
| 4,434,910 | A | 3/1984 | Groult |
| 4,453,647 | A | 6/1984 | Neat |

(Continued)

*Primary Examiner* — Steven A. Reynolds
*Assistant Examiner* — King M Chu
(74) *Attorney, Agent, or Firm* — Stephen J. Stark; Miller & Martin PLLC

(57) ABSTRACT

An open ended container with locking lid can provide a number of features. The lid and the container have cooperating threads. The lid has also has a locking mechanism connected to the lid, such as from a downwardly extending wall. The container has a stop, in some embodiments accessible from above, such as with downwardly and possibly linearly biased engagement members of the locking mechanism. In fact, some embodiments have a stop as a portion of satellite ring.

19 Claims, 2 Drawing Sheets

(56) References Cited

U.S. PATENT DOCUMENTS

| | | | | | |
|---|---|---|---|---|---|
| 4,491,238 | A | | 1/1985 | Tobolt | |
| 4,494,674 | A | | 1/1985 | Roof | |
| 4,512,484 | A | * | 4/1985 | Mar | 215/221 |
| 4,732,288 | A | * | 3/1988 | Morris, Sr. | 215/214 |
| 4,819,824 | A | | 4/1989 | Longbottom et al. | |
| 4,967,926 | A | * | 11/1990 | Morris, Sr. | 220/323 |
| 4,978,004 | A | | 12/1990 | Silverstein et al. | |
| 4,989,739 | A | | 2/1991 | Falcone et al. | |
| 5,027,954 | A | | 7/1991 | Hickerson | |
| 5,052,576 | A | | 10/1991 | Budenbendr | |
| 5,058,754 | A | | 10/1991 | Hickerson | |
| 5,125,538 | A | | 6/1992 | Morris, Sr. | |
| 5,147,060 | A | | 9/1992 | Lima et al. | |
| 5,167,344 | A | | 12/1992 | Van Schilt | |
| 5,190,181 | A | | 3/1993 | Budenbender | |
| 5,224,615 | A | | 7/1993 | Hickerson | |
| 5,265,751 | A | * | 11/1993 | Lima et al. | 220/288 |
| 5,295,601 | A | | 3/1994 | Bostelman | |
| 5,328,047 | A | | 7/1994 | Smith | |
| 5,377,858 | A | | 1/1995 | Morris, Sr. | |
| 5,452,748 | A | | 9/1995 | Simmons et al. | |
| 5,503,187 | A | | 4/1996 | Simmons et al. | |
| 5,520,296 | A | | 5/1996 | Freed | |
| 5,544,768 | A | * | 8/1996 | Gargione | 215/209 |
| 5,664,693 | A | | 9/1997 | Krall | |
| 5,692,628 | A | * | 12/1997 | Montgomery et al. | 215/43 |
| 5,735,427 | A | | 4/1998 | Hunter et al. | |
| 5,785,203 | A | | 7/1998 | Arshinoff et al. | |
| 5,788,098 | A | | 8/1998 | Mader | |
| 5,816,422 | A | | 10/1998 | Roig | |
| 5,865,330 | A | * | 2/1999 | Buono | 215/216 |
| 5,915,575 | A | | 6/1999 | Morris, Sr. | |
| 5,941,402 | A | | 8/1999 | Krueger | |
| 5,944,214 | A | | 8/1999 | Conti | |
| 5,947,462 | A | | 9/1999 | Roussel | |
| 6,006,942 | A | | 12/1999 | Morris, Sr. et al. | |
| 6,032,817 | A | | 3/2000 | Ejima et al. | |
| 6,036,036 | A | * | 3/2000 | Bilani et al. | 215/216 |
| 6,039,196 | A | * | 3/2000 | Ekkert et al. | 215/216 |
| 6,044,992 | A | * | 4/2000 | Ma | 215/44 |
| 6,105,809 | A | | 8/2000 | Yamanaka | |
| 6,176,381 | B1 | * | 1/2001 | Mader | 215/219 |
| 6,523,710 | B1 | * | 2/2003 | Hidding et al. | 215/252 |
| 6,776,302 | B2 | | 8/2004 | Morris, Sr. | |
| 6,926,165 | B2 | * | 8/2005 | Conti | 220/288 |
| 6,983,859 | B2 | | 1/2006 | Azzarello | |
| 7,513,384 | B2 | * | 4/2009 | Morris, Sr. | 220/302 |
| 2002/0017525 | A1 | * | 2/2002 | Searle et al. | 220/366.1 |
| 2004/0200839 | A1 | * | 10/2004 | Conti | 220/288 |
| 2005/0242055 | A1 | * | 11/2005 | Oh | 215/332 |

* cited by examiner

LOCKING LID CONTAINER

FIELD OF THE INVENTION

The present invention relates to a container with lid combination in which the lid could be placed in a locked configuration or an unlocked configuration wherein when in the locked configuration, the lid cannot be rotated relative to the container in an opening direction but when in an unlocked configuration, the lid can be so rotated.

BACKGROUND OF THE INVENTION

Locking lid and container configuration have been the subject of many efforts. In addition to the applicant's earlier efforts, many of which have been patented, others such as U.S. Pat. Nos. 3,902,620, 6,176,381, 5,544,768 and others show various locking configurations in which the locking mechanism is secured to the container and engages teeth on the lid. Similar techniques have been employed for providing a tamper indicator and is shown in U.S. Pat. No. 6,926,165. All these prior art designs are various ways of achieving the various objectives, however, the applicant believes that there is still room for improvement in the art of containers with locking lids.

SUMMARY OF THE INVENTION

It is an object of at least some embodiments of the present invention to provide an improved container and locking lid assembly.

It is another object of at least some embodiments of the present invention to provide a locking lid assembly with the lid and container having a locked configuration and an unlocked configuration wherein when transitioning from the locked to the unlocked configuration, a locking member is upwardly and possibly linearly displaced upwardly relative to teeth connected to the containers such as about a satellite ring.

It is another object of at least some embodiments of the present invention to provide a locking mechanism operably coupled to a lid, wherein the locking mechanism engages at least one of a plurality of stops on the container to provide a new locking system.

Accordingly, in accordance with a presently preferred embodiment of the preferred invention a locking lid and container system provides a container having radially outwardly directed threads or thread segments towards an upper end of the container having the opening into the interior of the container. The lid has cooperating threads and/or thread segments which allow the lid to be screwed onto the container.

The lid has a locking mechanism which is preferably oriented to engage upwardly extending stops connected to the container below the threads or thread segments connected to the container. In fact, in the preferred embodiment, the stops extend from a satellite ring which often at least substantially circumnavigates or circumscribes the container.

The locking mechanism preferably provides at least one, if not a plurality of engagement members, which are biased into a locking configuration downwardly. A release or operator is preferably connected to the engagement member(s) allowing the engagement members to be upwardly displaced to provide the unlocked configuration. In many embodiments, the engagement member(s) are disposed on a slide and are linearly displaced intermediate the locked and unlocked configurations. The stops are located at specific locations around the container, and in some embodiments, may be located all along the container.

Since the engagement members are biased into the locking configuration, as the lid is tightened relative to the container, the engagement members pass over the stops which preferably deflect the engagement member(s) upwardly when tightened, but prevent opposite turning with the engagement member(s) downwardly extending relative to the stops which could be like teeth having an angled surface to facilitate the upward motion of the engagement member(s) upon tightening. A ratcheting sound may be provided as the lid and container enter the locked configuration.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 4:
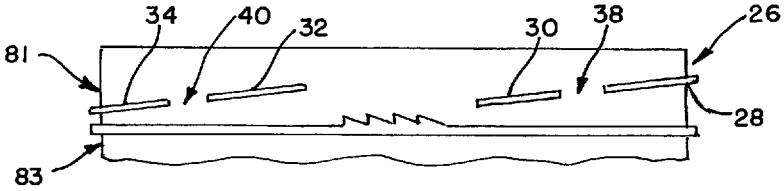
FIG. 4 is a front plan view of the container shown in FIGS. 1-3A with the lid removed.

A container 10 and lid 12 provide an assembly. The lid 12 has the capability of locking relative to the container 10. The lid 12 has a downwardly extending wall 14 with inwardly directed threads 16. The inwardly directed threads 16 are illustrated as thread segments 18, 20, 22, 24, but could be a single continuous thread in other embodiments. By providing multiple lower segments 20,24 someone installing the lid 12 relative to the container 10 may not be required to twist as far in order to have threads 16 engage outwardly directed threads of container 10 such as threads 26 shown in FIG. 4 which may similarly, or dissimilarly provided in the form of thread segments 28,30,32,34.

The multiple sets of upper segments 28,32 can provide similar capabilities, and when provided together with lower segments 20,24, a synergistic effect can be provided whereby a user can turn the lid in a first direction such as direction 36 to cooperate to tighten the lid 12 relative to the container 10 a minimal amount before at least some of threads 16 engage threads 26 as would be understood by those of ordinary skill in the art. Of course a single set of threads 26 could be employed in some embodiments. Also, although upper threads 28, 30 are anticipated to be initially engaged in the illustrated embodiment, if the gaps 38.40 are wide enough, lower thread portions 20,24 could initially engage lower portions 30,34 or other portions at least in some embodiments. It will be understood that the threads 16,26 cooperate to secure the lid 12 relative to the container 10 in a closed configuration.

Threads 26 are shown located above, at least partially above a satellite ring 82, Satellite ring 82 extends radially beyond surfaces 81 and 83 above and below the satellite ring 82 in a preferred embodiment. In fact satellite ring 82 may preferably also extend radially beyond threads 26 as well.

As the lid 12 is rotated in the first direction 36 relative to the container 10, eventually, the locking mechanism 42 can engage one or more stops 44 as will be explained in more detail if the rotation is reversed to the second direction 74. Stops 44 are shown as at least one, if not a plurality of teeth 46,48,50,52,54 as shown in the presently preferred embodiment. Each tooth 46,48,50,52, and 54 is shown having an angled leading surface 56 terminating in a vertical surface 58. This feature is not required for all embodiments. Engagement member(s) such as member 64 has an angled leading surface 62 terminating at vertical surface 60 and can be provided as one or more teeth, such as is illustrated or otherwise. It is presently preferred that at least one of stop 44 and/or engagement member(s) have vertical surfaces 58,60 which cooperate to lock the lid 12 relative to the container 10 in a locked configuration. It is also preferred, that at least one of stop(s) 44 and/or engagement member(s) have angled leading surfaces 56,62 and some may not have either or both of angled surfaces 56,62.

The leading surfaces 56,62 if angled can deflect a biased engagement member upwardly when turning the lid 10 in the closing direction, illustrated as the first direction 36. In fact, in a preferred embodiment, both the engagement member(s) 64 and stop(s) 44 have angled leading surfaces 52,62, however other embodiments may have different constructions. Furthermore the leading surfaces 56,62 need not necessarily begin at a terminating point of a vertical surface such as vertical surfaces 58,60 as illustrated, but could in some embodiments.

The locking mechanism 42 may have a slide 66 which moves relative to a housing 68. In the illustrated embodiment, the slide moves linearly along axis 70, but other embodiments may function differently. Operator 72 is useful to move engagement member(s) 64 upwardly out of engagement with stop(s) 44 to transition the lid 12 and container 10 combination from a locked to an unlocked configuration. Movement a predetermined distance upwardly along axis 70 moves the vertical surfaces 58,60 so that they clear one another thereby allowing rotation, when attempted, in a second direction 74 which is opposite first direction 36.

Spring 76 is shown in a preferred embodiment resiliently biasing the engagement member(s) 64 toward the stop(s) 44. Various spring configurations are known in the art. The illustrated spring 76 is shown connected to the housing 68 as well as to the slide 66 such as with entrapment within pockets 78,80. Other connection systems can be utilized as are known in the art. The operator 72, if provided, can overcome the bias of the spring 76 to upwardly displace the engagement member(s) 64 as desired by the user.

The locking mechanism 42 is shown connected to the downwardly extending wall 14 of the lid 12. The stop(s) 44 are shown extending upwardly from a satellite ring 82 which is illustrated below the threads 26 on the container 10. The stop(s) 44 is shown engaged from above by at least one of the engagement member(s) 64. Arms 84,86 are useful to connect the locking mechanism 42 to the downwardly extending wall 14. Other connection systems can be utilized with other embodiments.

The stop(s) 44 are shown to extend radially at least as far as threads 26 in a preferred embodiment, if not radially therebeyond. Placement of the locking mechanism 42 relative to the wall 14 will have an impact on where the stop(s) 44 are located for proper engagement in the locked configuration. In the illustrated embodiment, at least a portion of the stop(s) 44 are located radially at a similar radius as the threads 26.

Figure 5:
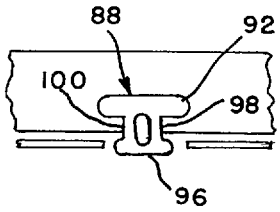
FIG. 5 is a back plan view of the container shown in FIGS. 1-3A and 4 with a tamper indicator installed.
Figure 6:
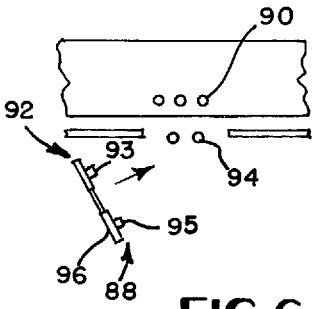
FIG. 6 is a back plan view of the container shown in FIGS. 1-3A and 4 prior to installing the tamper indicator.
Figure 7:
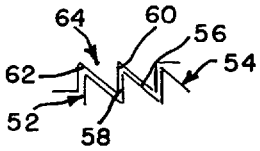
FIG. 7 is a front plan view of detail B shown in FIG. 2.

In a preferred embodiment, the locking mechanism 42 as it cooperates with the stop 44 does not provide tamper indication. Other embodiments could provide such a function. In this embodiment, if tamper indication is desired, tamper indicator 88 is shown in FIGS. 5 and 6. Tamper indicator 88 can be connected to lid 12 and container 10 at a location spaced from the locking mechanism 12. Specifically lid 12 is provided with bores or receivers 90 which receive extensions 93 from a first leg 92. Receivers 94 on the container receive extensions 95 from a second leg 96. The extensions 93,95 may be adhered into the receivers 90,94 or otherwise secured thereto in an effort to prevent undesired removal of the legs 92,96 relative to either of the lid 12 or container 10.

In operation, the arms 98,100 are designed to fail when subjected to rotational force before other portions of the tamper indicator 88 would fail. Other tamper indicators 88 may function differently.

Figure 1:
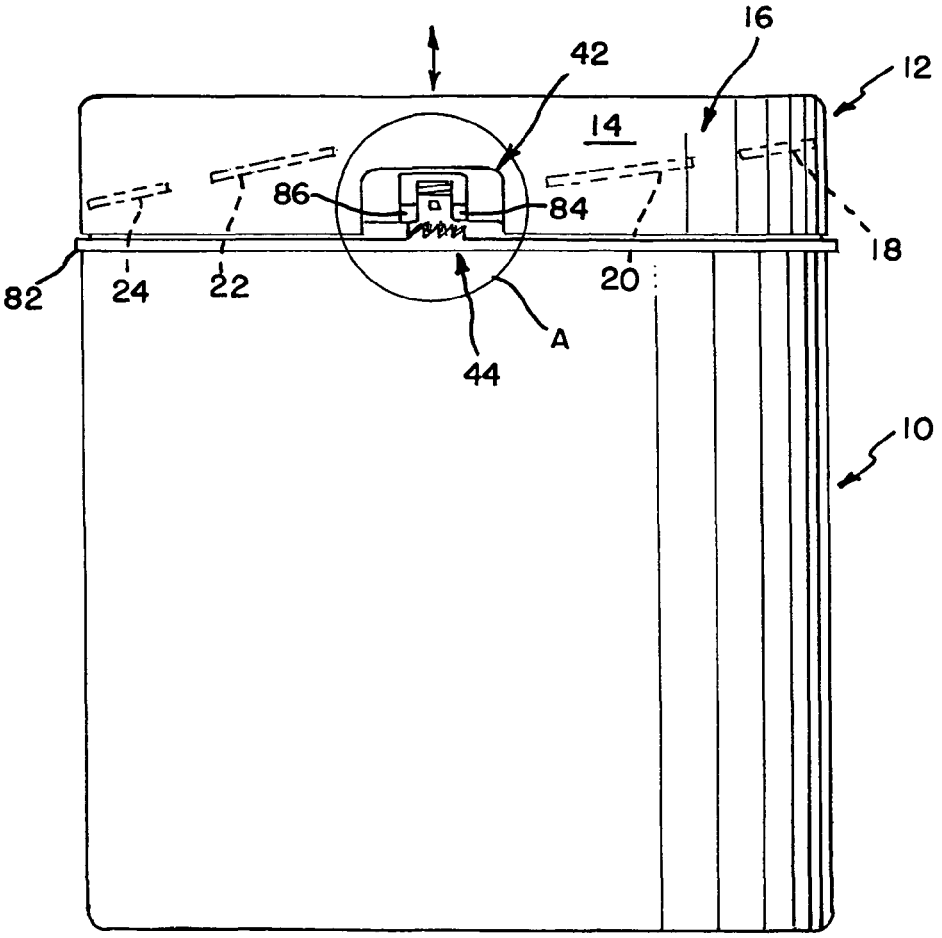
FIG. 1 is a front plan view of a lid and container system of a presently preferred embodiment of the present invention.
Figure 2:
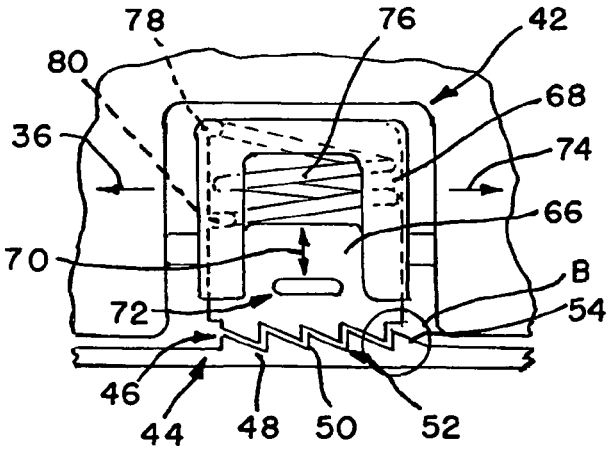
FIG. 2 is a detailed view of Detail A shown in FIG. 1.
Figure 3A:
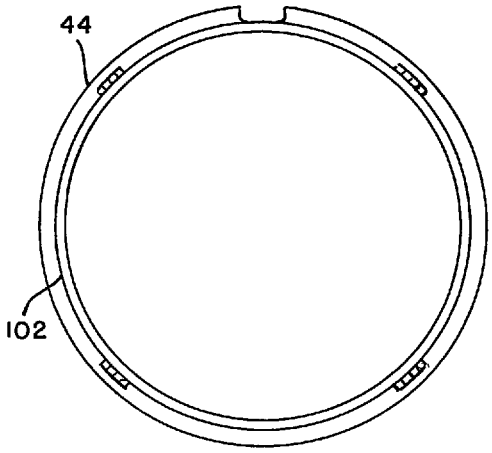
FIG. 3A is a top plan view of the container shown in FIG. 1 with the lid removed.
Figure 3B:
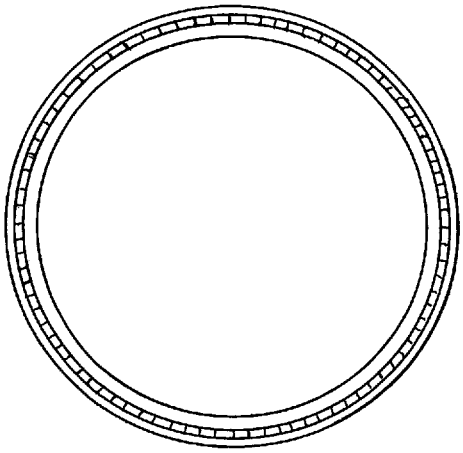
FIG. 3B is a top plan view of an alternative embodiment container as could be used with the lid shown in FIG. 1.

FIGS. 3A and 3B show possible constructions of containers. FIG. 3A shows four sets of stops 44 disposed about the satellite ring 82 of the container 10. Stops 44 are separated by planar upper surface 102 between adjacent sets of stops 44. FIG. 3B shows stops 44 at least substantially circumnavigating the satellite ring 82. Other embodiments may not provide stops 44 on satellite rings, but instead locate one or more stop(s) 44 at various desired locations relative to the container 10.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A container assembly comprising:

a container having an open end and outwardly directed threads extending from an outer exterior wall surface of the container, and at least one opening located below the threads;

a lid having a downwardly extending wall having inwardly directed threads configured to cooperate with the outwardly directed threads of the container to secure the lid relative to the container in a closed configuration;

and a locking mechanism connected to the downwardly extending wall of the lid, said locking mechanism having at least one engagement member; wherein the container assembly has a locked and an unlocked configuration, and when in the locked configuration, the at least one engagement member is prevented from rotation in a first direction with the at least one engagement member prevented from turning by engaging the at least one opening in the container, at a radial location at least as radially outwardly as the threads of the container and lid and movement of the at least one engagement member a predetermined amount upwardly disengages the at least one engagement member from the at least one opening thereby transitioning the container assembly to an unlocked configuration to allow rotation in the first direction, and said engagement member is downwardly biased by a spring in contact with the lid from above to the locked configuration.

2. The container assembly of claim 1 wherein the container has interrupted outwardly directed threads providing thread segments.

3. The container assembly of claim 2 the threads provide a plurality of starting positions for engagement with threads on the lid.

4. The container assembly of claim 2 wherein the at least one opening is in a satellite ring located below the threads and the at least one opening penetrates through the satellite ring, said satellite ring extending cantileveredly from an exterior wall surface and circumscribing a perimeter of the exterior wall surface of the container.

5. The container assembly of claim 1 wherein the locking mechanism further comprises an operator and a slide at least assisting in coupling the engagement member to the operator, and linear displacement of the slide with the operator transitions the locking mechanism from the locked to the unlocked configuration.

6. The container assembly of claim 1 wherein the lid has a tamper indicator located radially outwardly of the engagement member and is initially provided initially inhibiting access to the engagement member until removed.

7. The container assembly of claim 6 wherein at least one of the opening is a portion of a plurality of openings each terminating at a vertical surface and the at least one engagement member contacts the vertical surface of one of the openings in the engaged configuration.

8. The container assembly of claim 1 wherein at least one engagement member has at least one angled surface terminating at a vertical surface provided as a tooth.

9. The container assembly of claim 8 wherein the tooth is one of a plurality of similarly configured teeth extending from a slide biased in the locked configuration.

10. The container assembly of claim 9 further comprising a release extending from the slide, and upward movement of the release a pre-determined distance disengages the engagement member from the stop.

11. A container assembly comprising:

a container having an open end and outwardly directed threads extending from an outer exterior wall surface of the container, and at least one opening connected to the outer exterior surface of the container below at least a portion of the threads;

a lid having a downwardly extending wall having inwardly directed threads configured to cooperate with the outwardly directed threads of the container to secure the lid relative to the container in a closed configuration;

and a locking mechanism operably coupled to the lid, said locking mechanism having an engagement member; said container assembly having a locked and an unlocked configuration, the engagement member engaging at least one of the at least one openings in the container in the locked configuration thereby preventing rotation in a first direction, and the engagement member not engaging at least one of the at least one openings in the unlocked configuration allowing rotation in the first direction; and an operator operably coupled to the engagement member wherein movement of the operator upwardly a predetermined distance transitions the container assembly from the locked to the unlocked configuration thereby disengaging the engagement member from the opening, and said engagement member downwardly biased from above by a spring between the lid and the engagement member to the locked configuration.

12. The container assembly of claim 11 wherein the locking mechanism is connected to the downwardly extending wall of the lid.

13. The container assembly of claim 12 wherein the threads of the lid are interrupted thread segments and the locking mechanism is located between thread segments on the downwardly extending wall of the lid.

14. The container assembly of claim 11 wherein the at least one opening is a portion of a plurality of openings each terminating at a vertical surface and the engagement member contacts the vertical surface of one of the openings in the engaged configuration.

15. The container assembly of claim 14 wherein the openings are located on and extending through a satellite ring, with the satellite ring at least substantially circumscribing the container by extending cantileveredly and radially outwardly relative to the exterior side.

16. The container assembly of claim 14 wherein the openings are provided at spaced apart locations about and through a satellite ring circumscribing the container radially extending to the exterior wall of the container.

17. A container assembly comprising:

a container having an open end and outwardly directed threads extending from an outer exterior wall surface of the container, and at least one opening accessible from above;

a lid having a downwardly extending wall having inwardly directed threads configured to cooperate with the outwardly directed threads of the container to secure the lid relative to the container in a closed configuration when turned in a first direction;

and a locking mechanism operably coupled to the lid, said locking mechanism having an engagement member, and the container having a locked and unlocked configuration, wherein when in the locked configuration the engagement member engages the opening thereby preventing rotation in a second direction opposite the first direction at a location at least as radially outwardly as the threads of the container and the lid, and when in the unlocked configuration the lid is unencumbered by the opening allowing rotation in the second direction; and an operator operably coupled to the engagement member wherein movement of the operator upwardly a predetermined distance moves the abutment to the unlocked configuration from the locked configuration, and the engagement member is downwardly biased by a spring in contact with the lid from above into the locked configuration.

18. The container assembly of claim 17 wherein the opening is one of a plurality of openings.

19. The container assembly of claim 17 wherein the locking mechanism is connected to the downwardly extending wall of the lid and the opening passes through a satellite ring on the container which extends a maximum radius of the container.

* * * * *